US005526730A

United States Patent [19]

Zangrando

[11] Patent Number: 5,526,730

[45] Date of Patent: Jun. 18, 1996

[54] AUTOMATED AMMUNITION TRANSFER DEVICE

[75] Inventor: Roy A. Zangrando, Boonton, N.J.

[73] Assignee: The United States of America as represented by the Secretary of the Army, Washington, D.C.

[21] Appl. No.: 376,168

[22] Filed: Jan. 20, 1995

[51] Int. Cl.[6] ..... F41A 9/64

[52] U.S. Cl. ..... 89/34; 89/40.07; 89/46

[58] Field of Search ..... 89/34, 36.13, 40.07, 89/45, 46, 47

[56] References Cited

U.S. PATENT DOCUMENTS

| | | | |
|---|---|---|---|
| H793 | 7/1990 | Zangrando | 89/46 |
| 4,236,441 | 12/1980 | Turner et al. | 89/40.07 |
| 4,648,305 | 3/1987 | Elspass | 89/40.07 |
| 5,223,663 | 6/1993 | Bender-Zanoni et al. | 89/46 |

FOREIGN PATENT DOCUMENTS

| | | | |
|---|---|---|---|
| 2572172 | 4/1986 | France | 89/34 |

OTHER PUBLICATIONS

Pan, K. C., Army Research, Development & Acquisition Magazine, "Applications of Robotics & Artificial Intelligence to Armament", Sep.–Oct. 1983, pp. 15–17.

*Primary Examiner*—Stephen C. Bentley
*Attorney, Agent, or Firm*—Saul Elbaum; Edward Goldberg; Michael C. Sachs

[57] ABSTRACT

An ammunition transfer system, for large caliber artillery ammunitions of varying dimension, using a shuttle moveable through the transfer device's housing to transfer a projectile into or out of the said device. The said shuttle has gripping devices to engage the rotating band and base area of the projectile to release it according to biasing cams adjacent to the path of travel. The remainder of the projectile is supported by roller devices in the housing of the transfer device. A multiplicity of storage cavities provide the means to store projectiles. The said transfer device may be mounted to a positioning system capable of aligning it with any particular storage cell and transporting it to other destinations.

2 Claims, 8 Drawing Sheets

AUTOMATED AMMUNITION TRANSFER DEVICE

The invention described herein may be manufactured, used and licensed by or for the Government for Governmental purposes.

BACKGROUND OF THE INVENTION

1. Field of Invention

This invention relates in general to large caliber ammunition handling systems and in particular, to automated transfer of howitzer projectiles between storage locations.

2. Background of the Invention.

Self-propelled howitzer gun systems carry a basic load of ammunition on board which is periodically replenished by another delivery vehicle. The ammunition is typically unloaded manually directly to the howitzer or to the ground where it is later uploaded by the howitzer crew. In anticipation of the future employment of automatic loaders onboard these howitzers, the Army has issued a requirement for an automated resupply vehicle having automated machinery capable of passing ammunition directly to the howitzer. This "ammunition" is comprised of a multiplicity of special purpose projectiles, each having unique dimensional characteristics, thus complicating the solution. Various types of machinery to perform this task have been devised. They employ active, :moving storage cells and are typically very complex and costly. This invention allows for an automated ammunition transfer device which is simple, programmable, and employs fixed passive ammunition storage cells which are manually accessible. The invention relates to a "pick and place" type automated transfer device which is suitable for use on large caliber ammunition resupply vehicles and other locations which necessitate the mechanized transfer of ammunition. A positioning system transports a transfer head in line with a particular storage cell containing a projectile, whereupon a shuttle bearing gripping devices, extends from the transfer head over the base of the projectile, latches on to the rotating band and the base, and withdraws the projectile into the transfer head. The positioning system then transports the transfer head together with the projectile to a position in line with an exit conveyor, or a processing station, whereupon it is pushed into that device, and the positioning system moves to another storage cell. Conversely, the above can be reversed to receive a projectile from an entrance conveyor and deposit it in a storage cell.

SUMMARY OF INVENTION

1. It is an object of the invention to provide an automated ammunition transfer device to transfer large caliber ammunition between storage cells and other locations.

2. It is another object of the invention is to provide a standard transfer device which will be capable of gripping and handling the various types of fielded projectiles despite their dimensional variations, without adaptors or adjustments.

3. It is a further object of the invention to provide a transfer device which will permit the projectile to be entered or discharged from either end of the device (i.e.: nose first or base first).

4. Still further it is an object of the invention is to provide a transfer device which permits the manual transfer of ammunition without disassembly.

5. It is a further object of the invention is to provide a simple device for ease of maintenance and repair.

BRIEF DESCRIPTIONS OF THE DRAWINGS

Figure 14:
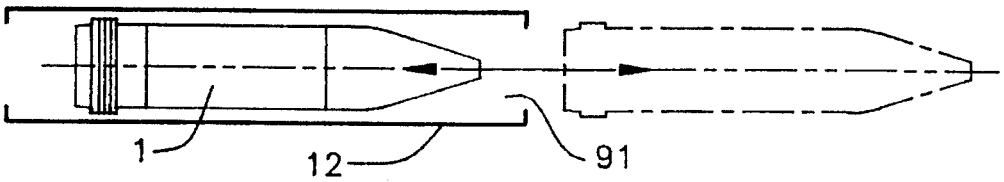
Figure 15:
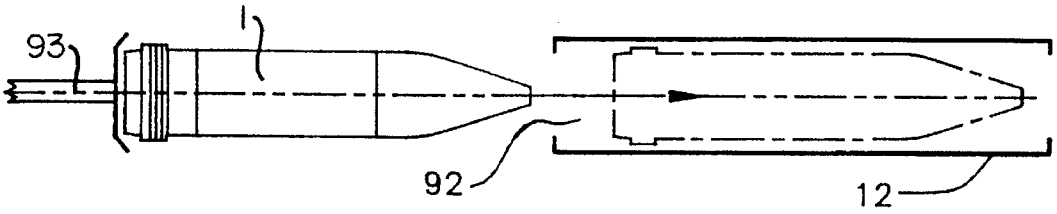
Figure 16:
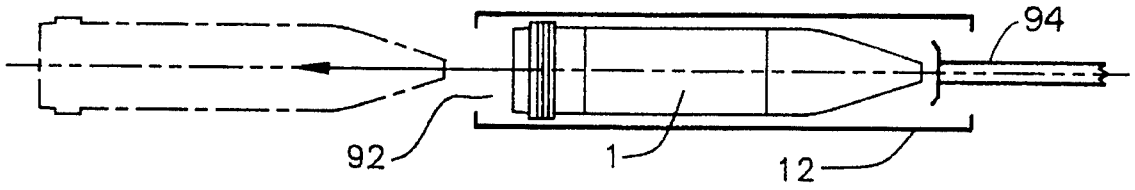

FIGS. 14, 15, & 16 are schematic representations showing variations in how the projectile enters and exits the transfer device.

Figure 9:
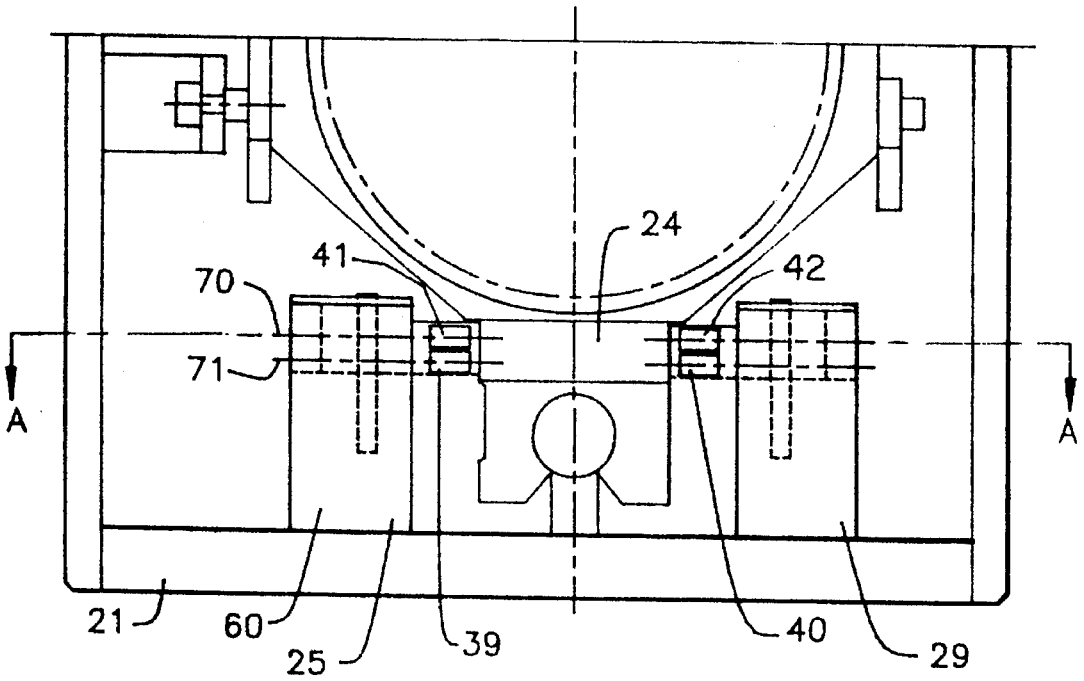
FIG. 9 is a partial cross section view of the transfer device showing the relationship of cam actuators to the gripper device.
Figure 17:
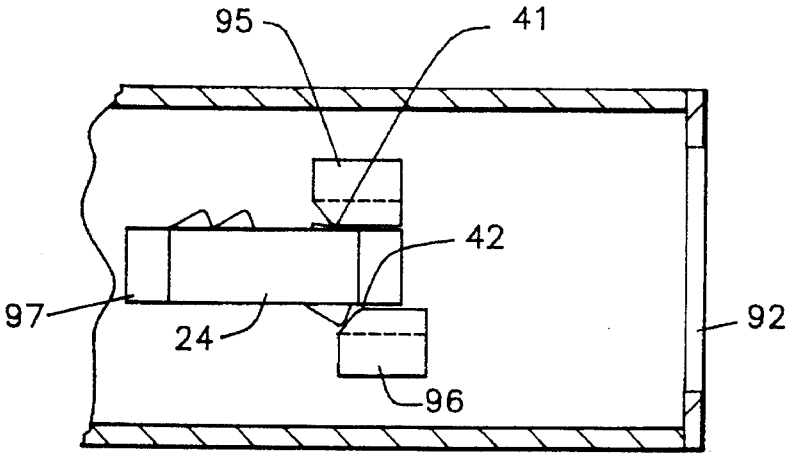

FIG. 17 is a partial plan view of the aft end of the transfer device taken at section A—A of FIG. 9, showing means to release a projectile for rearward removal.

DETAILED DESCRIPTION OF THE PREFERRED EMBODIMENT

Figure 1:
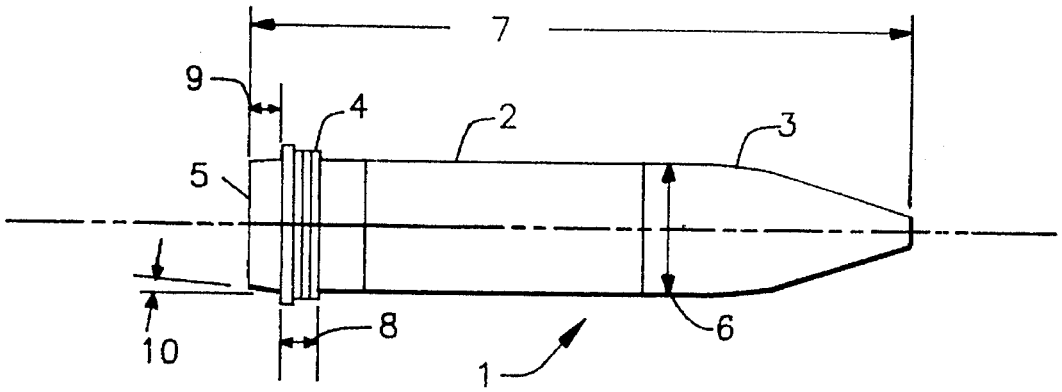
FIG. 1 is a side view of an artillery projectile referencing features relevant to the invention.

Turning now to FIG. 1., there is shown generally, an artillery projectile 1 typically of the type which will be handled by the subject invention. It is comprised of a body 2, an ogive 3, a rotating band 4, and a base 5. The group of projectiles of interest here all have the same diameter 6, but vary in the overall length 7, the length 8 of the rotating band 4, and both the length 9, and the angle 10 of the base 5.

Figure 2:
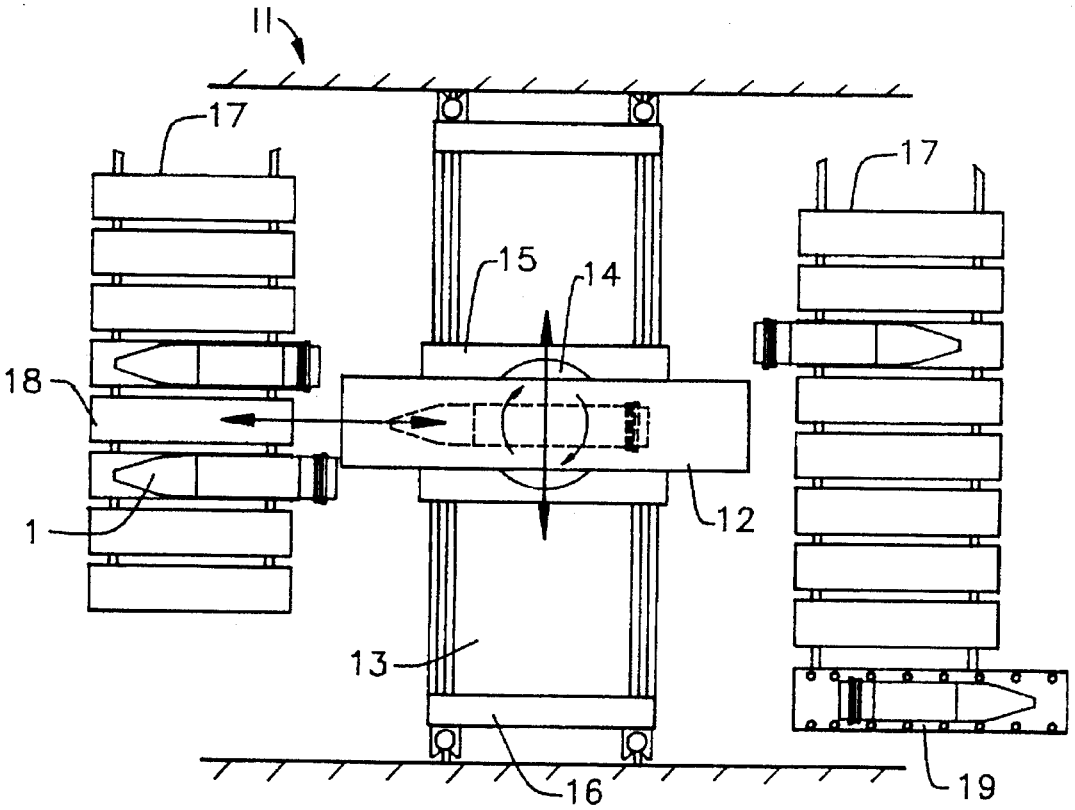
FIG. 2 is a schematic view of an ammunition transfer system in which the subject invention may be employed, showing the transfer device, storage cells, and a typical positioning system.

Referring now to FIG. 2, there is shown generally at 11, a typical projectile storage and transfer system employing the subject invention 12. Said transfer device 12, is mounted to a three degree of freedom positioning device 13 comprised of a rotator head 14 rotatable 180 degrees on a vertical carriage 15 which is in turn carried by a horizontal carriage 16. Said positioning device 13 is moveable between projectile storage racks 17, each comprised of a multiplicity of storage cells 18. This arrangement thus permits the transfer device 12 to be co-axially aligned with any storage cell 18, whereupon a projectile 1 may be removed from said cell, transported to another location such as another cell 18, or an exit conveyor 19, and inserted therein.

Figure 3:
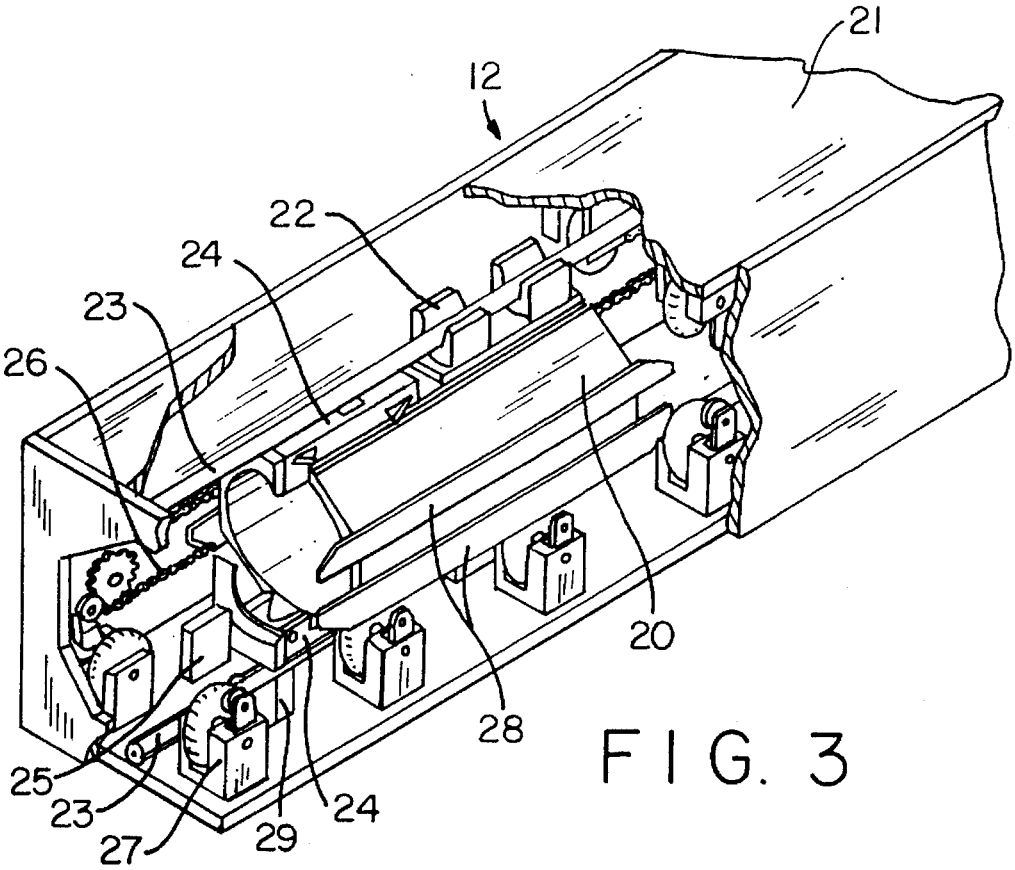
FIG. 3 is a pictorial view of the transfer device, partially cut away, showing the functional elements of the device.
Figure 4:
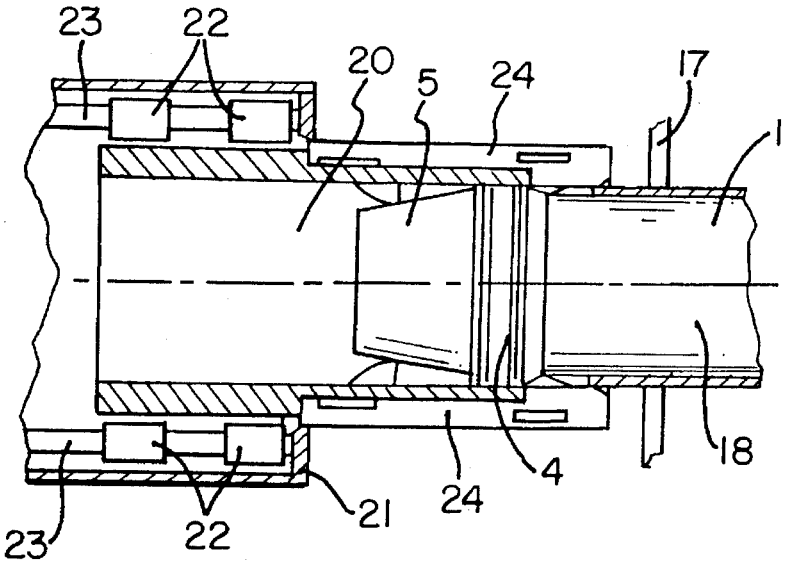
FIG. 4 is a partial side view, cut away, of the transfer device, showing engagement with a stored projectile.

Referring now to FIGS. 3 and 4, and in particular to FIG. 3, there is shown generally, a cutaway view 12 of the subject invention showing the functional element of the device. A hollow cylindrical shuttle 20, driven by roller chain 26 is moveable longitudinally within housing 21 guided by linear bearings 22 on shaftways 23. Said bearings 22 are positioned on the aft end of the shuttle 20 thereby permitting the forward end of shuttle 20 to extend out of the housing 21, and over the base 5 and rotating band 4 of the projectile 1, as shown in FIG. 4. A pair of opposing gripper assemblies 24 attached to the shuttle 20 provide means to grip and release projectiles according to specific interaction of said gripper assemblies 24 with cam actuators 25 and 29. A multiplicity of rollers 27 guide the projectile 1 as it is withdrawn into the transfer device 12. Said rollers 27 are retracted by roller cams 28 to permit the shuttle 20 to pass by.

Figure 5:
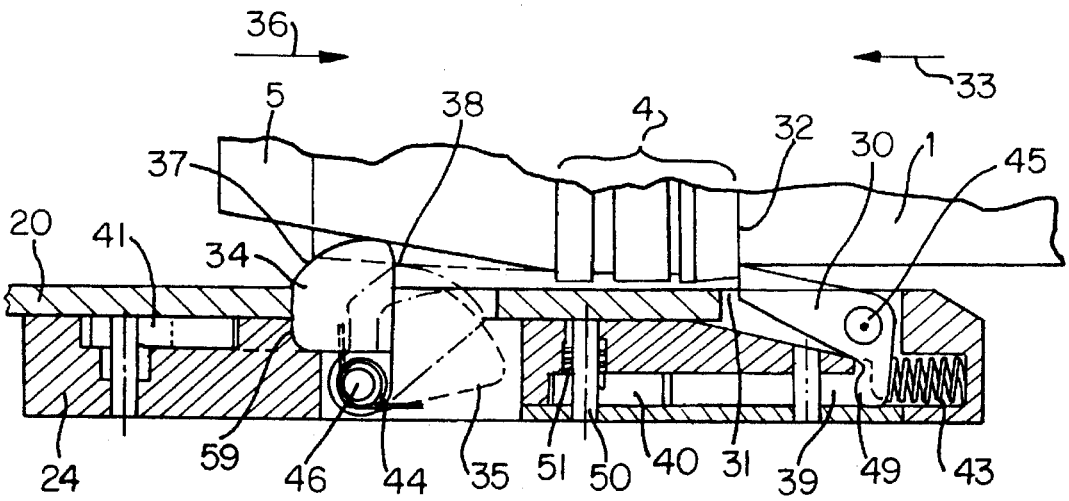
FIG. 5 is a partial side view section of a gripper assembly showing means to grip the projectile.

Referring now to FIG. 5, there is shown a partial section of a gripper assembly 24, on shuttle 20, engaging a projectile 1. A latch 30, moveable between the position shown (hereinafter referred to as "dropped") and that shown in outline at 31, is biased to the dropped position by springs 43. Said latch 30 engages the leading edge 32 of the rotating band 4, on projectile 1, thus permitting said gripper assembly 24 to move the projectile 1, such as from a storage cell, in the direction shown by arrow 33. A pusher 34, which may be lifted against the bias of torsion spring 44, to a position shown at 35, is biased to engage the conical surface of the base 5 of projectile 1, thereby permitting said gripper 24 to move projectile 1 in the opposite direction as shown by arrow 36. A contoured surface 37 on said cam 34 permits it to engage the base 5 of projectiles having different dimensional characteristics as shown typically at 38.

Figure 6:
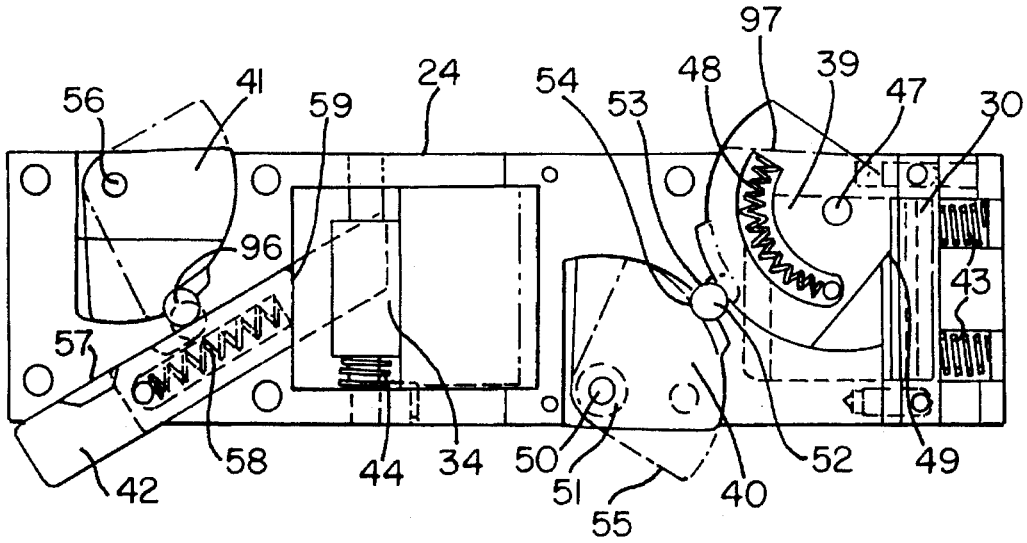
FIG. 6 is a plan view section of a gripper assembly showing the arrangements of cams which set and release the gripping features.

Referring now to the FIGS. 5 and 6, and in particular to FIG. 6, there is shown generally at 24, a gripper assembly, cut away to show cams 39, 40, 41 and 42, which operate the latch 30, and pusher 34 heretofore discussed. A stepped, latch lifting cam 39, rotatable about pin 47, is biased outward by compression spring 48. A cam lobe 49 on said cam 39, rests against latch 30 such that inward rotation of the cam 39 will lift the latch 30 from the projectile to the position shown at 31 in FIG. 5. A corresponding latch release cam 40, similarly stepped and rotatable about pin 50 in the same plane as cam 39 is normally biased outward by torsion spring 51. The relative positions of cams 39 and 40 are influenced by cylinder 52, slidable in slot 53. In the position shown in FIG. 6, cam 40 is restrained at its inward position by interference of said cylinder 52 at the step 54 between the outer and inner levels of said cam 40. Upon inward rotation of the cam 39, the outer surface of said cam moves out of contact with the cylinder 52 thus permitting said cylinder to move under bias of the inclined surface of step 54 on cam 40 to the lower level of cam 39 whereupon cam 40 is biased outward to the position shown at 55 by torsion spring 51, to correspondingly lock cam 39 in the inward position shown at 97. The latch 30 is thus locked in the position shown at 31 of FIG. 5 where it cannot engage a projectile. Conversely, inward rotation of cam 40, releases cam 39, and in turn latch 30 is again dropped. Note that when the latch 30 is down, it is not locked in that position, but free to move up and down as influenced by the rotating band 4 as the gripper assembly 24 passes over the projectile.

In a manner similar to the above described operation, cam 41, rotatable about pin 56 and biased outward by a torsion spring (not shown) and; cam 42, slidable in slot 57 biased outward by compression spring 58, interact through cylinder 96 together in a plane different from that of cams 39 and 40. Inward movement of cam 42 lifts the pusher 34 at 59, and is locked in position by rotation of cam 41. Subsequent rotation of cam 41 will release cam 42 and drop the pusher 34. The pusher does not lock in the down position.

Figure 7A:
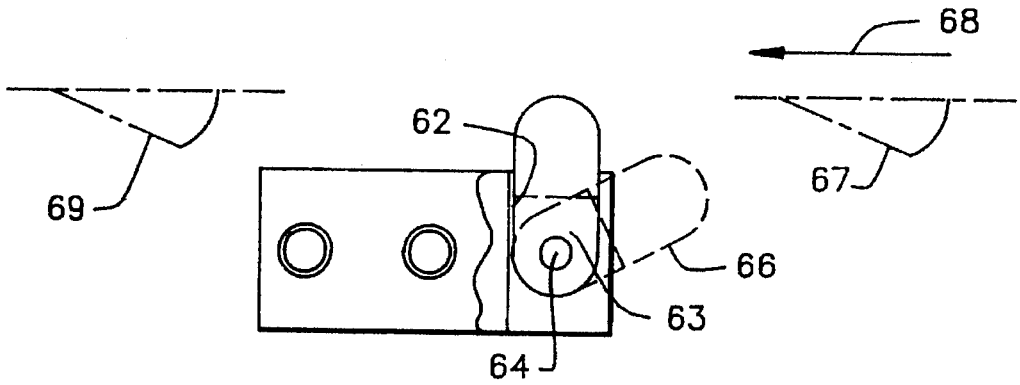
FIGS. 7A and 7B are a top view and side view partially cut away, of a cam actuator.
Figure 7B:
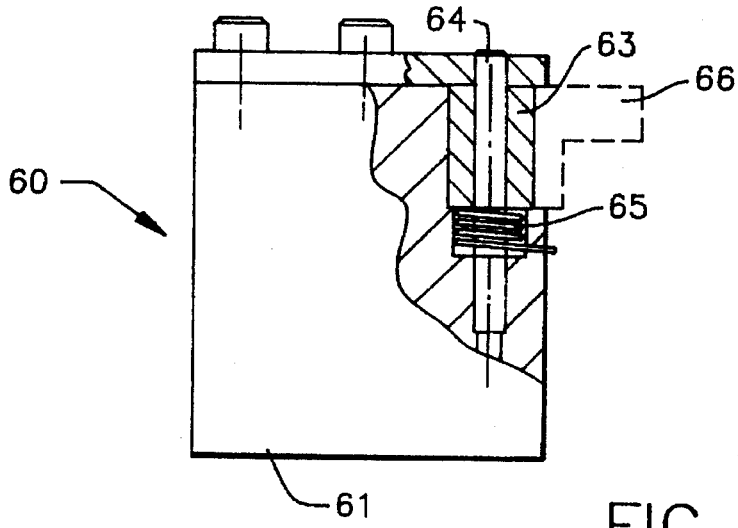

Referring now to FIGS. 7A and 7B, there is shown generally at 60, a typical cam actuator. A base 61, features a step 62 having set therein, an oblong cam 63, moveable about pin 64, and biased by torsion spring 65 to rest against the step 62. Under external bias, said cam 63 resists movement in the direction of the step 62, but gives way easily to bias in the opposite direction by moving to a position such as that shown at 66. Typically, a gripper assembly cam, as shown at 67, moving in the direction shown by arrow 68, would be actuated by cam 63; whereas a similar cam 69, moving by the actuator from the opposite direction would push cam 63 out of its way (to position 66), and itself remain unactuated.

Figure 8:
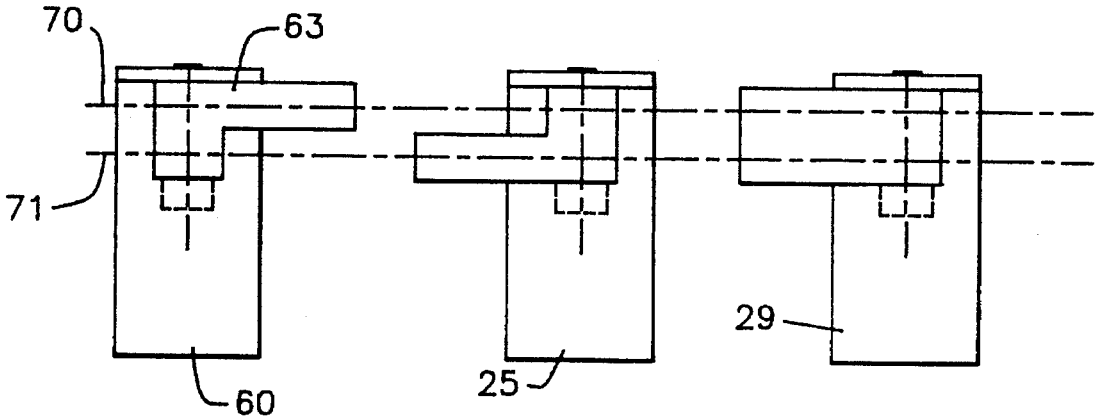
FIG. 8 is a comparison of the three types of cam actuators used in the invention.

Referring now to FIGS. 8 and 9, there is shown in FIG. 8, three types of cam actuators differing primarily in the plane of operation as determined by the vertical boundaries of the cams contained thereon, Cam actuator 60 interacts with cam 41 on the inner level 70 of the gripper assembly 24, which controls the pusher 34. Cam actuators 25 interacts with a cam 39 on the outer level 71 of the gripper assembly 24 which controls the latch 30. Cam actuator 29 interacts with cams 40 and 42 on both levels 71 and 70 respectively of the gripper assembly 24, as shown in FIG. 9.

Figure 10:
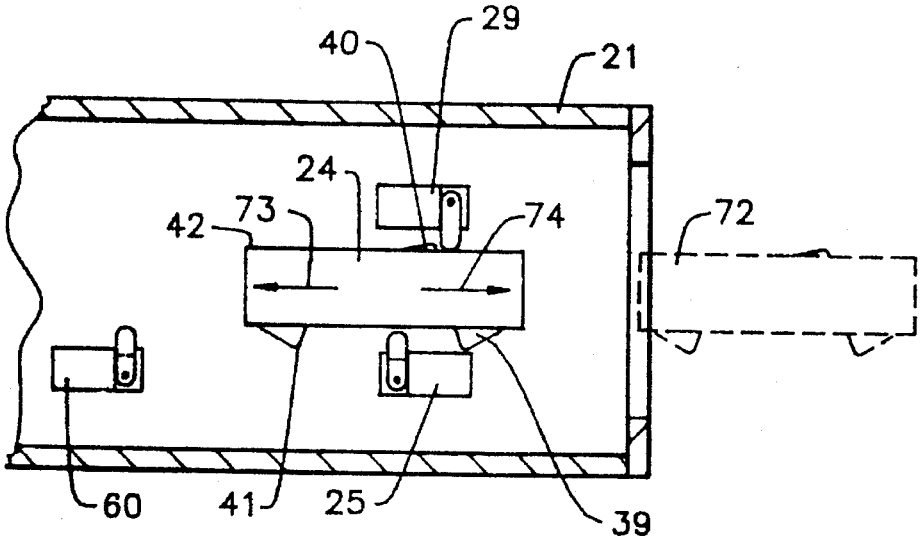
FIG. 10 is a partial plan view of the forward end of the transfer device, taken at section A—A of FIG. 9, showing means to function the gripper device.
Figure 12:
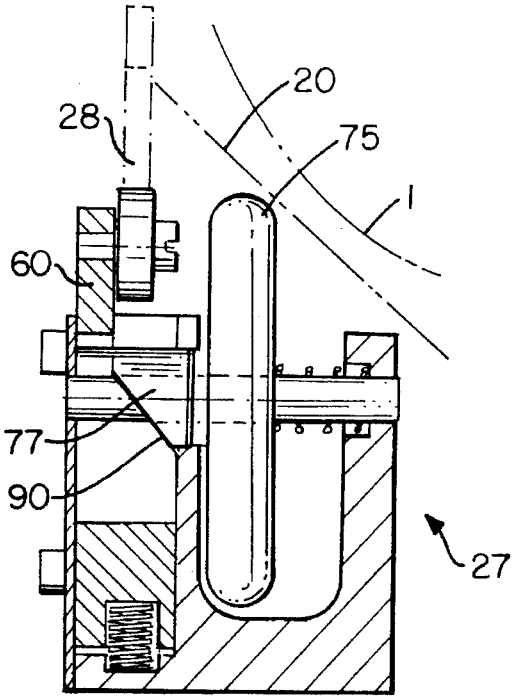
FIG. 12 is a front view of a roller assembly, taken in partial section, and showing the device in the actuated position.

Referring now to FIG. 10, there is shown a partial view of the invention taken at section A—A of FIG. 9 and further showing the interaction of the gripper assembly 24 with cam actuators 29, 25, and 60. The gripper assembly 24 is shown in the "ready" position configured to retrieve a projectile, having reached that position from the extended position as shown by outline 72. In moving from said position 72, both cams 42 and 40 were actuated by cam actuator 29 which in turn lifted the pusher 34 (not shown), and dropped the latch 30 (not shown) respectively. Cam 41, being on a different level than the cam actuator 25, did not interact at all.

Referring now to FIGS. 4, 5, and 10, the gripper- cam actuator interaction sequence during projectile transfer, is as follows: Beginning at the "ready" position as shown in FIG. 10, the shuttle 20 with the gripper assembly 24 moves forward out of the housing 21 to the position outlined at 72, to engage projectile 1 as shown in FIG. 4. The latch 30, in the down position, rides over the rotating band 4 and engages the leading edge 32. The pusher 34 is in the raised position as shown by outline 35 of FIG. 5. The shuttle 20 (and gripper 24) now reverse direction to withdraw the projectile 1 from the cell into the transfer device. As the gripper assembly 24, moving in the direction shown by arrow 73, passes cam actuator 29, there is no interaction since both cams 40 and 42 are already depressed. As it passes cam actuator 25, cam 41, being on a different level, is unaffected. Cam 39 pushes actuator 25 out of its way and thus also remains unaffected. As the gripper assembly passes cam actuator 60, cam 41 is depressed thus dropping the pusher 34, which self adjusts to engage the projectile base 5. Cam 39 being on a different level, does not interact. The shuttle continues on to fully withdraw the projectile 1 into the transfer device, whereupon said transfer device transports it to an exit location. At said exit location, the shuttle 20 moves forward, as shown by arrow 74 in FIG. 10, to expel the projectile 1. As the gripper assembly 24 passes by the cam actuators 60, 25, and 29, cam 39 is actuated by actuator 25, lifting the latch 30. Cam 42, now extended, displaces actuator 29 and remains unaffected (ie: the pusher is still down and pushing). Upon full extension, the shuttle 20 again reverses direction, leaving the projectile 1 in place, and moves back to the ready position, lifting the pusher 34 and dropping the latch 30 as it passes cam actuator 29. The device is now ready for the next cycle.

Figure 11A:
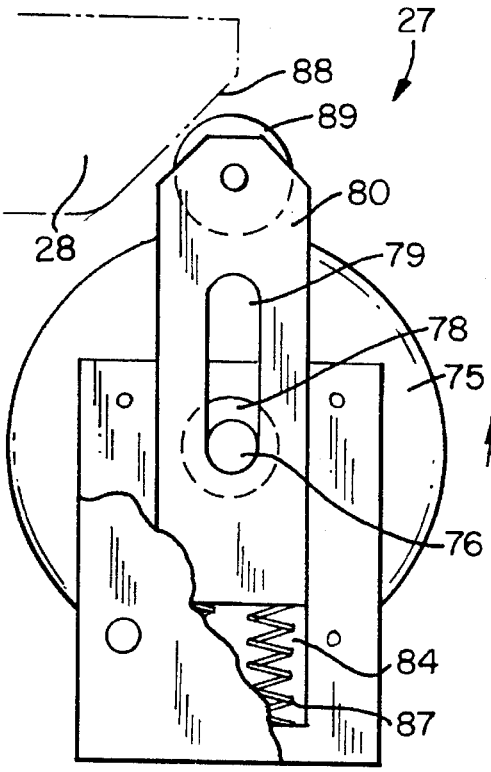
FIGS. 11A and 11B are a front and side view respectively of a roller assembly, taken in a partial section, showing the device in the unactuated position.
Figure 11B:
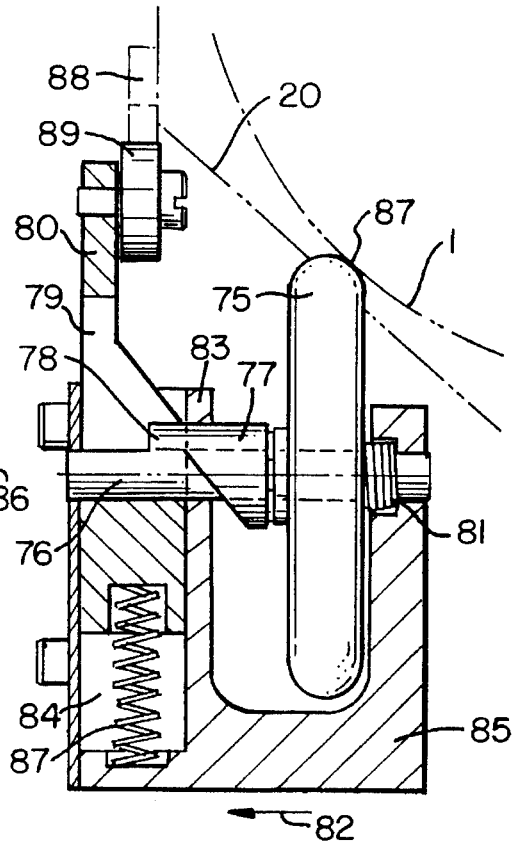

Referring now to FIGS. 11A and 11B, there is shown in two views, a typical roller assembly 27, used to support and guide the projectile 1 on the axis of the transfer device. The roller assembly 27 is comprised of a roller 75 slidable and rotatable freely on shaft 76 and; a ramped bushing 77, also slidable on shaft 76, but restrained from rotating by a tang 78 which extends into slot 79 of cam follower 80. A spring 81 biases both roller 75 and bushing 77 to move outward (shown by arrow 82) but for the constraint provided by cam follower 80 against a step on bushing 77 at 83. Said cam follower 80 is slidable in slot 84 of roller assembly base 85 and biased upward (shown by arrow 86) by springs 87.

Referring now to FIGS. 3, 11, 12, and 13, roller cams 28, extending from each end of the shuttle 20, are positioned to actuate cam followers 80 of the roller assemblies 27, before said shuttle 20 reaches the rollers 75. As the shuttle 20 approaches a set of roller assemblies from either direction, the inclined surface 88 on the leading end of the roller cams 28 contact the roller 89 on cam follower 80, forcing said cam follower 80 downward. The wide portion of said cam follower 80, heretofore providing interference to movement of the bushing 77, is displaced, thus allowing said bushing 77 and roller 75 to move from the position shown in FIGS. 11A and 11B, where said roller supports the projectile 1 at 87, to the position shown in FIG. 12 where clearance is provided for the shuttle 20. When the cam follower 80 is released from the roller cam 28, springs 87 force the follower upward, which in turn, via the inclined surface 90, returns the roller 75 to the position as shown in FIGS. 11A and 11B.

Figure 13:
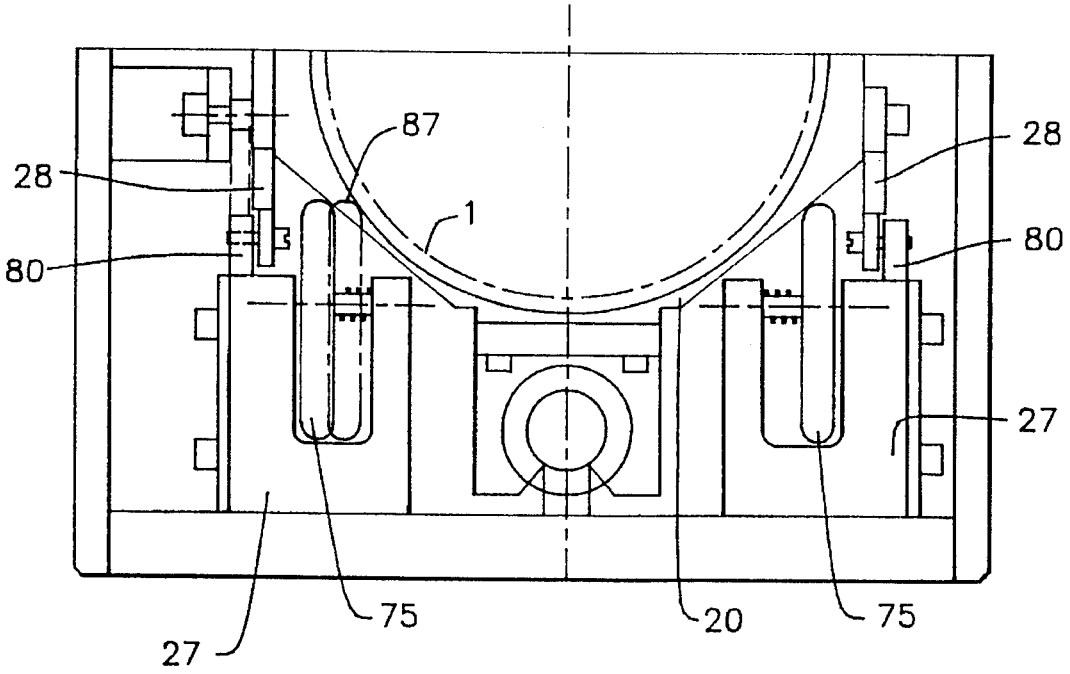
FIG. 13 is a partial cross section of the transfer device showing the relationship of the roller assemblies to the projectile and shuttle.

Referring now to FIG. 13, there is shown a partial section view of the transfer device taken at one set of roller assemblies 27, and shown with the cam followers 80 of said roller assemblies 27 in the downward position, having been depressed by roller cams 28. The rollers 75 are shown in their corresponding positions allowing the shuttle 20 to pass. The normal unactuated position of roller 75 is also shown in the outline contacting the projectile 1 at 87.

Referring now to FIGS. 14, 15, and 16, there is shown various ways in which a projectile may enter or be discharged from the transfer device. FIG. 14 depicts the normal mode of operation, as heretofore described, whereby the projectile 1 may enter the transfer device base first, or exit nose first, from the front end 91, under control of the mechanism comprising said transfer device.

FIG. 15 depicts the use of an external pusher 93 to push the projectile, nose first, into the transfer device through the rear port 92, where it is engaged by the gripper assembly 24. Referring now to FIGS. 5 and 15, said engagement is accomplished by positioning the shuttle 20 at the rear end of the transfer device with both the latch 30 and the pusher 34 down. As the projectile 1 passes through the shuttle 20, nose first, it displaces the pusher 34, which under bias of the torsion spring 46, follows the contour of the projectile, maintaining constant contact and continues until the leading edge 32 of the rotating band 4 rests against the latch 30. At this point the projectile is engaged by the gripper assembly 24 as shown in FIG. 5.

FIG. 16 depicts the use of an external pusher 94 to move the projectile, base first, out thru the rear port 92 of the transfer device. To remove the projectile 1 in this manner, it must first be released from the gripper assembly 24 which occurs at the extreme end of travel of the shuttle 20. Referring now to FIG. 17, there is shown a partial plan view of the invention at the aft end of the transfer device. The gripper assembly 24 is shown at the extreme end of travel where the inner level cams 41 and 42 interact with fixed cam actuators 95 and 96 respectively to lift the pusher, in the same manner as heretofore described for cam actuators 25, 29, and 60, thus permitting the projectile to be moved rearward. Said cam actuators 95 and 96 are relatively positioned such that upon subsequent forward movement of the shuttle, cam. 42 is released prior to cam 41 permitting the pusher to drop. In normal operation, the shuttle will stop short of the extreme position with the gripper assembly in the position shown by outline 97.

Thus it is apparent that in accordance with the present invention a functional design that fully satisfies the objectives, aims and advantages is set forth above. While the invention has been described in conjunction with a specific embodiment, it is evident that many alternatives, modifications and variations will become apparent to those skilled in the art in light of the foregoing description. Accordingly, it is intended that the present invention embrace all such alternatives, modifications, and variations as fall within the spirit and broad scope of the appended claims.

What is claimed is:

1. An ammunition transfer and storage system providing for automated transfer of large caliber artillery ammunition projectiles between storage locations in said system, the system comprising:

a plurality of storage racks with open ended cavities, each cavity for storing a projectile, said projectile having a base region and a rotating band;

transfer head means for engaging a desired projectile which projectile is resident in a cavity in axial alignment to the long axis of said cavity, or for disengaging such projectile, said transfer head means comprising a hollow cylindrical shuttle means of inside diameter larger than the outside diameter of any of the projectiles base regions for gripping and pulling such projectile to acquire same, while for pushing such projectile to store same, and further including roller means to support sections of such projectile that are not handled by said shuttle means; and means for aligning said transfer head means to any projectile in any of said cavities as desired.

2. The system as in claim 1 wherein said shuttle means is movable into and out from said transfer head means to respectively move a projectile into or out from said transfer head means, and wherein said shuttle means inside diameter is wide enough to also engage and grip the rotating band of such projectile as desired.

* * * * *